United States Patent [19]

Munk et al.

[11] Patent Number: 4,540,988

[45] Date of Patent: Sep. 10, 1985

[54] BROADBAND MULTI-ELEMENT ANTENNA

[75] Inventors: Benedikt A. Munk, Columbus, Ohio; Clayton J. Larson, North Hollywood, Calif.

[73] Assignee: The United States of America as represented by the Secretary of the Navy, Washington, D.C.

[21] Appl. No.: 503,457

[22] Filed: Jun. 13, 1983

[51] Int. Cl.[3] ..... H01Q 3/24; H01Q 21/00

[52] U.S. Cl. ..... 343/728; 343/789; 343/855

[58] Field of Search ..... 343/725, 726, 728, 729, 343/745, 748, 789, 845, 876, 700 MS, 708, 371, 374, 375, 846, 797, 850, 853, 855, 893, 905; 333/101, 103, 262

[56] References Cited

U.S. PATENT DOCUMENTS

| | | | |
|---|---|---|---|
| 1,708,944 | 3/1929 | Heising | 343/893 |
| 2,149,333 | 3/1939 | Brown | 343/798 |
| 2,465,381 | 3/1945 | Libby | 343/430 |
| 2,924,823 | 10/1955 | Carter | 343/751 |
| 3,569,971 | 3/1971 | Griffee | 343/725 |
| 3,713,167 | 1/1973 | David | 343/789 |
| 3,882,506 | 5/1975 | Mori et al. | 343/728 |
| 3,922,685 | 11/1975 | Opas | 343/876 |
| 4,123,759 | 10/1978 | Hines et al. | 343/876 |
| 4,454,514 | 6/1984 | Itoh et al. | 343/700 MS |

OTHER PUBLICATIONS

Munk et al., "A Broadband Cavity Antenna with a Steerable Cardioid Pattern", 1980 Int'l Symposium Digest, IEEE Conference, Quebec, Can., Jun. 2-6, 1980, pp. 298-301.

*Primary Examiner*—Eli Lieberman
*Assistant Examiner*—Michael C. Wimer
*Attorney, Agent, or Firm*—Robert F. Beers; Frederick A. Wein

[57] ABSTRACT

A broadband multi-element antenna is presented. The antenna comprises a monopole centrally disposed within a cavity of the body, and a plurality of antenna elements disposed at ninety degree increments about the periphery of the cavity. A plurality of isolation traps are connected between selected pairs of the antenna elements. The isolation traps are half-wavelength transmission lines which permit excitation of the respective plurality of elements by input signals which are of equal amplitude and 180° out-of-phase but are short circuits between the respective pairs for in phase signals parasitically induced from the monopole. Additionally, switching traps are connected to respective ones of the antenna elements. The switching traps comprise quarter-wave transmission lines which are switchable to ground and selectively provide a short circuit of signals at the respective ones of the elements for changing the radiation pattern of the antenna.

2 Claims, 4 Drawing Figures

BROADBAND MULTI-ELEMENT ANTENNA

BACKGROUND

The present invention relates to multi-element antennas, and more particularly, to the switching of antenna elements for changing the radiation and receiving patterns of a radio frequency antenna.

For an airplane, it is desirable that the antenna pattern be changeable and have a band width of at least 25 percent with a cardioid pattern switchable to scan in 90° steps. The simplest and most widely known method for producing a cardioid pattern is to place two dipoles or monopoles at a distance of one wavelength from each other and to feed the antenna elements 90° out of phase. However, this presents difficulties in that for an airplane it is desirable that the antenna be flush mounted and a band width of 25 percent is difficult to obtain under all required circumstances. One approach to this problem is to use a flush mounted cavity which is exited either by monopoles or loops, with the number of loops depending upon how it is desirable to steer the beam. For example, if four loops are mounted in a cavity and fed with a linear phase delay of 360° around the circumference, i.e. the four loops are exited with phases 0°, 90°, 180°, and 270°, the radiation pattern of the horizontal plane of the four loops will be omnidirectional as will the pattern of a monopole. However, while the phase of the radiated signal from the monopole will remain constant around the antenna in the horizontal plane, the phase of the signal from the four loops will change 360°. Thus, for some direction, the signals from the four loops and the signal from the monopole will be in phase. If at the same time the ampitude of the two signals are equal, a null will be produced in the combined radiation pattern in the direction of the null. By changing the phase relationship in the plane of the monopole and the four loops, the beam can be steered in the horizontal plane.

Another variation is to excite only two oposing loops at 180° out of phase. This approach gives a broader null and higher gain. However, whereas the four loops, can be easily scanned continuously in the horizontal plane, excitation of only two oposing loops permits radiation in 90° steps.

It has been determined that for multi-element antennas the radiation pattern of the antennna is not as predicted. One reason for this is parasitic excitement between the elements and a second reason is that voltages induced between elements is not of the proper phase. For the antenna of the exemplary embodiment, it has been found that there is parasitic excitment between the two loops and that the voltages induced in the two loops from the central monopole was in phase rather than 180° out of phase. In such a case, while the push-push mode signals in phase will never actually enter through the input terminal, they will excite the antenna in a push-push mode with respect to ground.

Accordingly, it is desirable to reduce the distortion radiation pattern of an antenna caused by parasitic excitation between the elements. It is also desirable to provide for the short circuiting of antenna elements when the voltages in the elements produce push-push currents in phase which are caused by parasitic excitation while letting the push-pull current (180° out of phase) produced by an input voltage to pass unobstructed.

SUMMARY OF THE INVENTION

Briefly, a broadband multi-element antenna is presented. The antenna comprises a monopole centrally disposed within a cavity of the body, and a plurality of antenna elements disposed at ninety degree increments about the periphery of the cavity. A plurality of isolation traps are connected between selected pairs of the antenna elements, the isolation traps are half-wavelength transmission lines which permit input excitation of respective pairs of the plurality of elements by input signals which are of equal amplitude and 180° out-of-phase but are short circuits between the respective pairs of elements for in phase signals parasitically induced from the monopole. Additionally, switching traps are connected to respective ones of the antenna elements. The switching traps comprises quarter-wave transmission lines which are switchable to ground and selectively provide a short circuit of signals at the respective ones of the elements for changing the radiation pattern of the antenna.

OBJECTS OF THE INVENTION

Accordingly, it is an object of the present invention to provide a radio frequency push-push isolation trap for short circuiting signals which are equal in amplitude and in phase while permiting transmission of signals appearing at the antenna elements which are equal in amplitude and 180° out of phase. It is another object of the present invention to provide a radio frequency switching trap comprising a transmission line with an effective electrical length of one-fourth wavelength ($\frac{1}{4}\lambda$) connected in series with a switchable means for connection between elements of an antenna and signal ground for short circuiting selected elements of the antennna to signal ground. The further object of the present invention is to provide a radio frequency multi-element antenna wherein signals between two elements which are equal in amplitude and 180° out-of-phase are allowed to pass unobstructed.

Further objects and advantages of the present invention will become apparent as the following description proceeds and features of novelty characterizing the invention will be pointed out with particularity in the claims annexed to and forming part of this specification.

DESCRIPTION OF THE DRAWINGS

For a better understanding of the present invention reference may be had to the accompanying drawings wherein.

DETAILED DESCRIPTION OF THE PREFERRED EMBODIMENT

Figure 1:
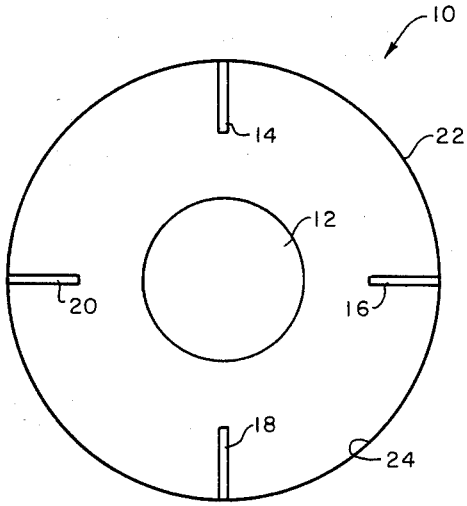
FIG. 1 is a representative plan view of the radio frequency multi-element antenna of the present embodiment.
Figure 2:
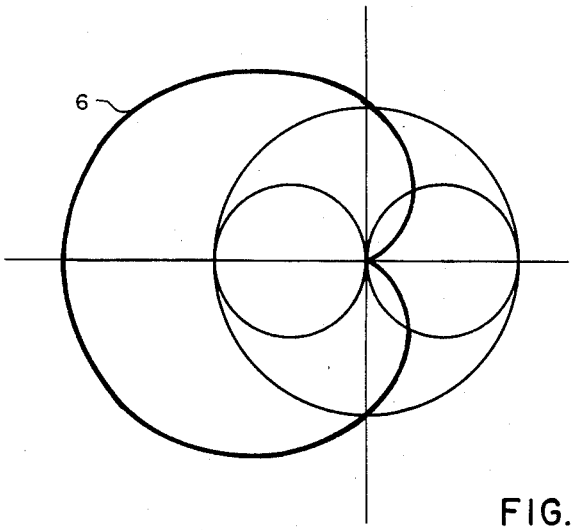
FIG. 2 is the radiation pattern of the elements and of the total radiation pattern of the antenna of FIG. 1.

Referring now to the figures wherein like members are designated by like numerals, there is shown in FIG. 1 an antenna, generally designated 10, which in the exemplary embodiment comprises a monopole 12 and a plurality of loops 14, 16, 18, and 20 which are embedded within a body 22 defining a cylindrically shaped cavity 24. As stated above, the problem with such antenna is to achieve a symmetrical radiation pattern because of the close coupling between the elements. The present antenna is designed to operate in a frequency range of 1.0 to 1.25 GHz with a VSWR of 2 with a front to back ratio greater than 20 dB. Monopole 12 is top loaded and mounted in the center of the configuration. Any two opposing loops are excited with current of equal amplitude and 180° out of phase. This assures that the coupling between the monopole 12 and any two opposing pairs of loops will ideally be 0° if the four loops 14, 16, 18, and 20 are fed with signals of equal amplitude but with a progressive phase, namely 0°, 90°, 180°, and 270°. It can be shown that the radiation pattern for these four loops will change by 360° as one moves around the antenna in the horizontal plane. Thus at a certain direction in the horizontal plane, the loop field and the monopole field will be exactly in phase while, the opposite direction they will be exactly out of phase and if the two fields are of the same magnitude, a complete cancellation will take place as shown by pattern 6 of FIG. 2. The advantages of this antenna is the permitting of rotation of the radiation pattern of cardioid 6 and since the loops are fed out of phase, there is no need for special 90° hybrid feeding of two sets of loops. Thus, antenna 10 comprises two set antennas interlaced with each other, namely, one antenna set consisting of two loops producing the figure "8" pattern and monopole producing the omnidirectional pattern. In order to produce a perfect figure "8" pattern, the two opposing loops are fed in series rather than in parallel. This will assure that the two loops are always fed 180° out of a phase.

However, the feeding of two loops 180° out of phase in a balanced configuration from an unbalanced signal source, requires the use of a balun. In the exemplary embodiment, a strip line version of a Roberts balun is used for reducing radiation output from the balun. The balun provides a balanced output from DC up to frequencies where the transmission line deteriorates. With this configuration, a null of 20 dB can be produced. However, two problems with the present antenna 10 manifest themselves. The first problem is the cause by voltages induced in the two loops from the monopole are in phase rather than 180° out of phase. Thus although the push-push mode will never enter through the balun from the unbalanced input terminal, the push-push signal will excite the balun in a push-push mode with respect to ground.

The parasitic excitation of the loops leads to a distorted radiation pattern of the monopole which very much caused by the loading condition of the loops. To prevent this loading it is necessary to short circuit the loops to ground when the induced voltages in the two loops produce push-push currents while letting the push-pull current produced by an input voltage at the loop input to pass unobstructed.

Figure 3:
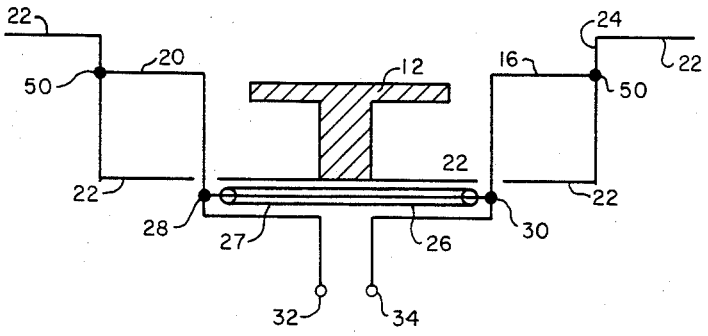
FIG. 3 is a cross-sectional representation of the antenna of FIG. 1.

In accord with the present invention, push-pull currents are allowed to pass unobstructed while push-push currents are short circuited in order to correct the above stated distortion of the radiation pattern of the monopole because of coupling to the loops. Referring now to FIG. 3 there is shown a representation of the antenna of FIG. 1 in cross-section. As shown in FIG. 3, a transmission line 26 having an effective electrical length of approximately $\lambda/2$ is connected between input terminals 28,30 of loops 16, 20 or 14, 18 as the case may be. Assuming a push-push signal is applied to the balanced input terminals 32, 34, at each end 28, 30 of the connection of the interconnecting transmission line 26, a wave will travel toward the center of transmission line 26 and at the center the two voltages will meet in phase, i.e. add together just like the interconnecting cable was open circuited at this point. Since the distance between this "open circuit" to the two ends 28, 30 is $\lambda/4$, the two end points 28,30 see the equivalent of a short circuit, i.e., the push-push mode voltages at points 28,30 will be stopped. On the other hand, if a push-pull mode voltages are applied to terminals 32,34, i.e., the input signals at terminal 32,34 are equal in amplitude but 180° out of phase, the voltages meeting at the center of the transmission line 26 will now be 180° out of phase, i.e., they will cancel thus producing an equivalent short circuit at the center of the interconnecting cable transmission line 26. In such a case, an equivalent open circuit is produced at the two ends 26, 30 of transmission line 36 and the push-pull mode voltage in the feeding lines will be permitted to pass unobstructed.

In the exemplary embodiment, the push-push isolation traps were constructed of RG-58U cable stripped of the PVC coating with care taken to insure good contact between the braids of the shield 27 and the ground plane of body 22 to prevent transmission line 26 from radiating.

Figure 4:
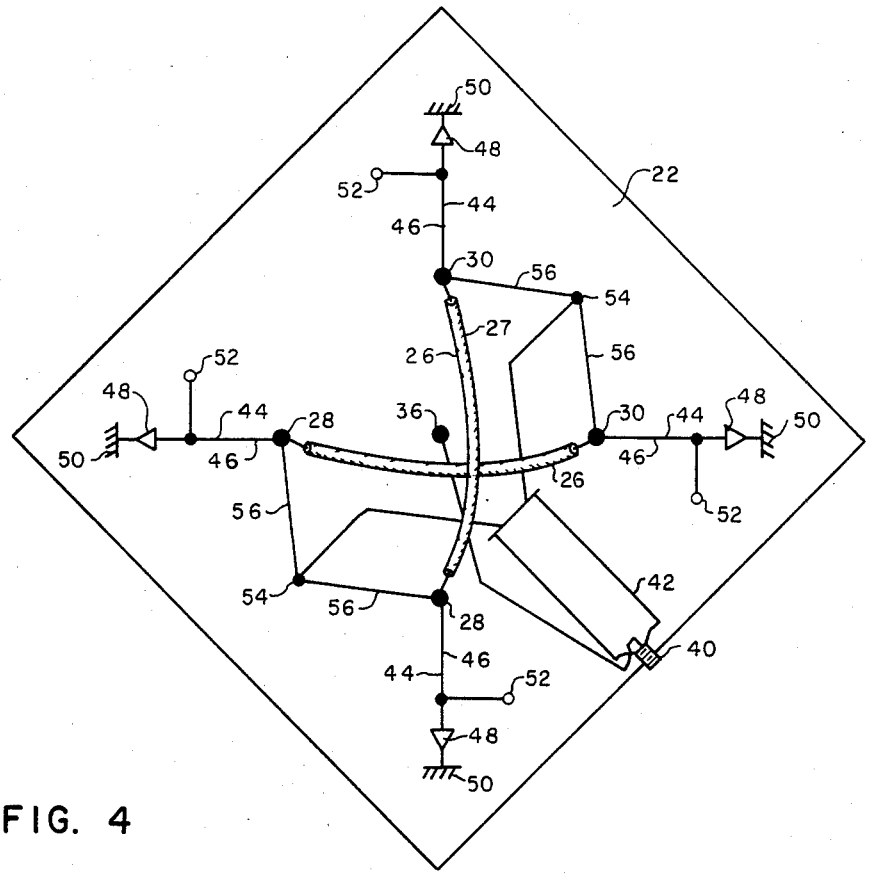
FIG. 4 is a representation of a bottom view of the antenna of FIG. 3.

Referring now to FIG. 4 there is shown a strip line of the bottom of the antenna circuitry of FIG. 3 as applied to the antenna 10 of FIG. 1.

FIG. 4 shows each of a pair of opposite loops having respective terminals 28, 30 with each pair of loops being fed by an input 40 to balun 42. Monopole 12 is fed by signal input 40 being fed to terminal 36 before the input signal is acted upon by balun 42. Each of the four loops 14, 16, 18, and 20 are connected to signal ground by a switching trap 44 which comprises a transmission line 46 of effective electrical length, $\lambda/4$ which is terminated in a switching diode 48, which in turn is connected to electrical or signal ground 50. The diodes 48 are switchably actuatable from an external source connected to terminal 52 and when diode 48 is conducting, the other end of the $\lambda/4$ trap attains a high impedence and a signal will flow freely to the respective loop. If on the other hand the diode 48 is open, a short circuit is obtained at the other end of trap 44 and no signals can flow to the respective loop. It should be noted that the $\lambda/4$ wavelength lines 46 are positioned wavelength $\lambda/4$ away from the signal input point 54 connecting to opposing loops. This insures no disturbance in other interconnecting lines when the $\lambda/4$ trap produces a short circuit at the respective loop, i.e., the diodes 48 are open.

The two branch points 54 are connected to the respective terminal 28, 30 by transmission lines 56 which are all approximately $\lambda/4$ in effective electrical length. This is done so that when switching traps 44 act like short circuits at the input of one set of loops, a high impedance will be produced at the point 54 and the energy transferred to the other set of loops will not be disturbed. It is within the contemplation of the present invention that other appropriate electronic switching devices can be substituted for diodes 48.

Thus there is disclosed a multi-element radio frequency antenna provided with push-push isolation traps comprising a transmission line of effective electrical length of $\lambda/2$ for short circuiting signals between two points which are equal in amplitude and in phase and permitting unobstructed transmission of signals which are equal in amplitude and 180° out of phase. Additionally there is presented a multi-element radio frequency antenna having switching traps comprising a transmission line of effective electrical length of $\lambda/4$ in series with switchable means such as a diode for switching selected elements of the antenna for directionally changing the radiation pattern of the antenna.

While there has been illustrated what is at present considered to be a preferred embodiment of the present invention, it will be appreciated that numerous changes and modifications are likely to occur thus skilled in the art and it is intended in the appended claims to cover all those changes and modifications which fall within the true spirit and scope of the present invention.

What is claimed is:

1. A broadband multi-element antenna operational at radio frequencies comprising in combination:

a body providing a ground plane and defining a cylindrically shaped cavity disposed within the body, a monopole antenna element disposed radially central of the cavity, said monopole being excitable by radio frequency signals provided from an external source, a plurality of antenna elements disposed at ninety degree increments about the periphery of the cavity, spaced from the monopole but electrically interactive with the monopole and excitable by said signal frequencies from said external source, said plurality of elements being switchably fed for changing the radiation pattern of the antenna, a plurality of isolation traps connected between selected pairs of the plurality of antenna elements, each of said isolation traps comprising a first transmission line of effective electrical length of one-half wavelength, said first transmission line being an open circuit at the signal inputs of the respective antenna elements when signals at the inputs to the selected pairs of the antenna elements are of equal amplitude and 180° out of phase, and a short circuit at the respective pair of elements when in phase radiated signals from the monopole parasitically excite the respective pair of antenna elements and a plurality of switching traps connected one to each of the plurality of antenna elements, each of the switching traps comprising a second transmission line having an effective electrical length of one-quarter wavelength and a switchable means connected in series with said second transmission line to ground for selectively deactivating the respective elements in pairs for changing the radiation pattern of the antenna, the second transmission line being a short circuit at the selected radio frequency of the signal, the switchable means being actuatable from an external source.

2. The antenna of claim 1 wherein the switching traps further comprise a third transmission line having an effective electrical length of a quarter wavelength connected between the respective antenna element and a signal source, the second transmission line being connectable to ground by the switchable means for short circuiting the signal at the respective antenna element to ground, the series circuit of the second and third transmission lines comprising a half-wavelength transmission line so that the signal source sees an open circuit and is generally uneffected by the actuation of the switchable means.

* * * * *